US007441314B2

(12) United States Patent
Frisch et al.

(10) Patent No.: US 7,441,314 B2
(45) Date of Patent: Oct. 28, 2008

(54) APPARATUS FOR INSTALLING A SEAL IN A NOZZLE BEAM

(75) Inventors: Jurgen Frisch, Erzhausen (DE); Ullrich Munstermann, Egelsbach (DE)

(73) Assignee: Fleissner GmbH, Egelsbach (DE)

( * ) Notice: Subject to any disclaimer, the term of this patent is extended or adjusted under 35 U.S.C. 154(b) by 93 days.

(21) Appl. No.: 11/699,220

(22) Filed: Jan. 29, 2007

(65) Prior Publication Data

US 2007/0176026 A1 Aug. 2, 2007

(30) Foreign Application Priority Data

Jan. 30, 2006 (DE) ..... 10 2006 004 459

(51) Int. Cl.
*D04H 1/46* (2006.01)
*B05B 1/14* (2006.01)

(52) U.S. Cl. ..... 28/104; 28/167

(58) Field of Classification Search ..... 28/104, 28/105, 167; 239/553, 553.3, 553.5, 566, 239/568, 597, 590, 590.3, 590.5, 600
See application file for complete search history.

(56) References Cited

U.S. PATENT DOCUMENTS

| | | | | | |
|---|---|---|---|---|---|
| 3,613,999 | A * | 10/1971 | Bentley et al. | 28/104 |
| 4,069,563 | A | 1/1978 | Contractor et al. | |
| 4,880,168 | A * | 11/1989 | Randall et al. | 239/553.5 |
| 5,042,722 | A * | 8/1991 | Randall et al. | 28/105 |
| 5,692,278 | A | 12/1997 | Fleissner | |
| 5,778,501 | A * | 7/1998 | You | 28/104 |
| 6,012,654 | A | 1/2000 | Fleissner | |
| 6,810,565 | B2 * | 11/2004 | Fleissner | 28/104 |
| 2005/0082398 | A1 * | 4/2005 | Noelle et al. | 239/597 |
| 2005/0139700 | A1 * | 6/2005 | Noelle | 239/589 |

* cited by examiner

*Primary Examiner*—Amy B Vanatta
(74) *Attorney, Agent, or Firm*—Andrew Wilford

(57) ABSTRACT

A nozzle beam formed with an annular groove is fitted with a seal ring by an apparatus having an elongated support bar, a pair of holders fixed on the bar spaced apart sufficiently that the seal ring can be stretched between them, and a release element for pushing the seal ring off one of the holders.

11 Claims, 5 Drawing Sheets

APPARATUS FOR INSTALLING A SEAL IN A NOZZLE BEAM

FIELD OF THE INVENTION

The present invention relates to an apparatus for installing a seal in a nozzle beam. More particularly this invention concerns an apparatus for putting a new O-ring into a filament-tangling or -needling nozzle beam.

BACKGROUND OF THE INVENTION

In the production of various textiles, a mat of filaments or fibers is subjected to so-called needle jets of water at extremely high pressure so as to entangle the filaments and impart a desired bulkiness to the mat. This is done by passing the mat underneath a nozzle beam that extends horizontally above the moving mat or web and that emits one or more rows of the needle jets, the row or rows extending perpendicular to the web/mat travel direction.

The nozzle beam as described in U.S. Pat. Nos. 4,069,563, 5,692,278, and 6,012,654 has an elongated housing formed with a downwardly open chamber that is pressurized with the treatment liquid, typically water, and that extends as mentioned above transversely to the web/mat travel direction. The bottom wall of the housing is formed with an elongated slot and is formed around this slot with an upwardly open annular groove holding an O-ring that projects above an upper face of this bottom wall. A nozzle sheet lies atop this O-ring, which actually is not circular but which instead is oblong and at least 1 m long has two long straight and parallel side regions bridged at the ends by semicircular regions, and is held thereagainst by the high pressure in the housing chamber. The liquid passes through small holes in the needle sheet to form the treatment jets.

In view of the pressures being used, the needle sheet and O-ring of such a device are subjected to considerable wear and need to be replaced periodically. In the oldest machines the entire housing was dismantled to do this, but more modern systems such as in above cited U.S. Pat. No. '654 have a setup for installing such an oblong seal or an O-ring in a holder or seal-ring groove in a nozzle beam or a housing for the nozzle beam.

To this end the nozzle beam is typically formed with closable access slots that open into the chamber immediately above the upper face of the bottom wall formed with the groove holding the O-ring at each end of the beam. When the O-ring (and frequently also the nozzle sheet) need to be replaced, the chamber is drained and ports at the end of this slot are opened. Then the worn parts are removed. A fresh O-ring is fitted to a tool that stretches it, thereby reducing its cross-sectional diameter, and this tool is threaded through the nozzle beam to align the stretched O-ring above the groove it is to fit to. Then the O-ring is pried at each end off the tool and, if all goes well, it snaps into place in the groove. The old or a fresh nozzle sheet is put back in position, the ports are closed, and the apparatus can be refilled and reused.

This servicing operation, which is a regular occurrence, therefore requires two people to perform, one at each end of the beam. One fits the tool carrying the stretched seal through the beam, then both of the service personnel work the seal off the tool and fit it into the groove. The job cannot be done readily by one person.

OBJECTS OF THE INVENTION

It is therefore an object of the present invention to provide an improved apparatus for installing a seal in a nozzle beam.

Another object is the provision of such an improved apparatus for installing a seal in a nozzle beam that overcomes the above-given disadvantages, in particular that allows the installation to be accomplished easily by a single person.

SUMMARY OF THE INVENTION

An apparatus for mounting an elastomeric seal ring in the groove has according to the invention an elongated support bar, inner and outer holders fixed on the bar spaced apart sufficiently that a seal ring can be stretched between them and can be pushed off the inner holder by a release element into a groove in a nozzle beam.

Thus according to the invention the O-ring may easily be inserted by only one operator into the installation opening provided in the nozzle beam and precisely positioned over the corresponding seal-ring groove for holding the O-ring, and then by use of the release device may be pushed off the holder on the inner end away from the operator, so that on account of its pretensioning this part of the seal may easily snap into the seal-ring groove for the seal. On the outer end of the unit closer to the operator, the other part of the seal may then be pushed by hand into the seal-ring groove. This is a very time-saving type of installation, and may be carried out by only one person. In addition only one end of the beam needs to be opened up to do it.

To this end, it is advantageous for the release device and the O-ring holding device to basically formed as elongated flexible bars lying parallel and flatly against each other. In addition a pressure rail or bar is associated with the release device. By adjusting the release device with respect to the O-ring holding device the O-ring may be easily pushed down off the inner holder, and by use of the pressure rail introduced into a seal-ring groove.

According to one refinement of the invention, it is also possible for the release device to have a release element on one side that in a given position of the release element may be brought into contact with the O-ring. The release element provided on the holder is easily manufactured, and is very well suited for pushing down the O-ring by the holder, corresponding to the adjustment of the support release element.

For this purpose it is advantageous for the support release element of the release element to define an angle $\alpha$ greater than 90° with respect to a surface of the release element, preferably between 120° and 150°. A shallow inclination of the support release element allows the actuating forces for adjusting the release device to be kept small, which is useful for very long release devices.

Lastly, according to one preferred embodiment of the approach according to the invention, in the region of one end of the O-ring holding device a slot open to the inner end is provided by means in which the release element can slide to rest against a portion of the O-ring and to push out the O-ring from an annular groove provided in a holder. This slot extends right through the center of the inner holder.

For the present invention it is particularly important that at least the release device and the O-ring holding device form an installation tool whose overall height approximately corresponds to that of the repair slot provided in the nozzle beam or in the housing for the nozzle beam, so that the installation tool can move in the repair slot in such a way that the O-ring may be positioned in the region of the seal-ring groove by use of the installation tool, and may be positioned to align the O-ring directly above of the groove to which it must be fitted. The pressure rail pushes the O-ring seal down into the seal-ring groove after reaching the space above the seal-ring groove for holding the O-ring, and by use of the release device is pushed down by the holders.

In conjunction with the design and configuration according to the invention, it is advantageous for the distance between the holders to be greater than the distance between two annular parts of the closed or one-piece O-ring, so that side regions of the O-ring seal run approximately parallel to one another. This ensures that the O-ring does not detach from the holders when the installation tool is pushed into the installation opening in the nozzle beam.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
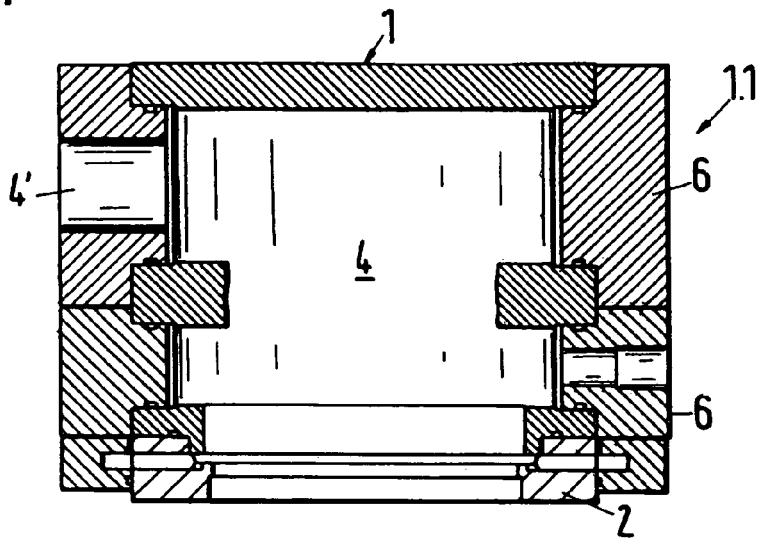
FIG. 1 is a foreshortened longitudinal section through a nozzle beam.
Figure 5:
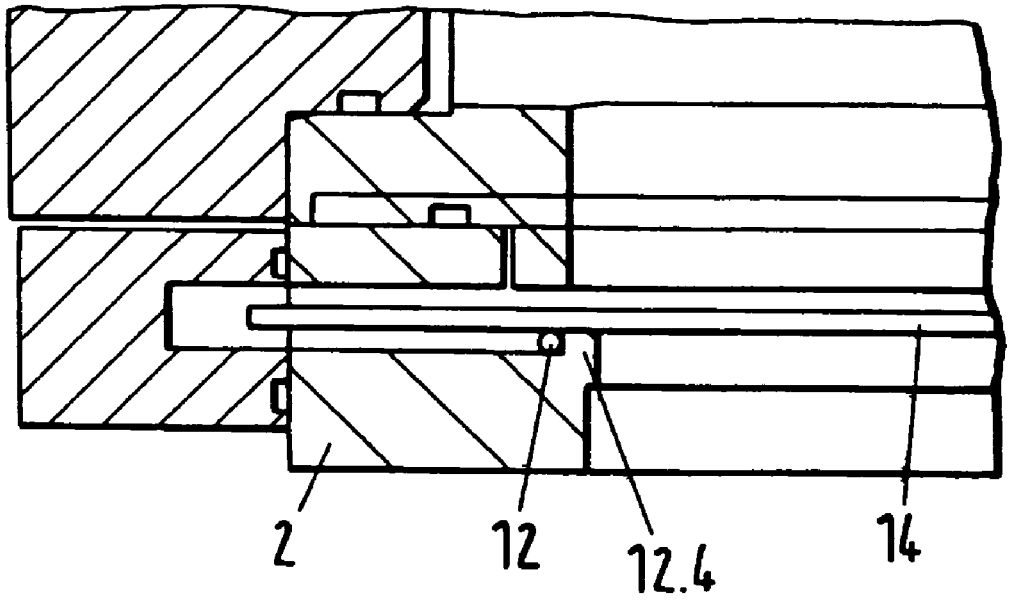
FIG. 5 is a large-scale view of a detail of FIG. 1.

As seen in FIG. 1 a nozzle beam for a nozzle strip 14 (FIGS. 5 and 10) comprises an upper part 1 bolted from below to a lower part 2 with an O-ring 11 clamped between them. The upper part 1 has an upper pressure chamber 4 and a lower distribution chamber 5. Both chambers 4 and 5 have one longitudinal end normally closed in a liquid-tight manner by respective covers 6 and 7. On the other end face the pressure chamber 4 has a port 4.1 by means of which it is pressurized with treatment liquid.

Figure 6:
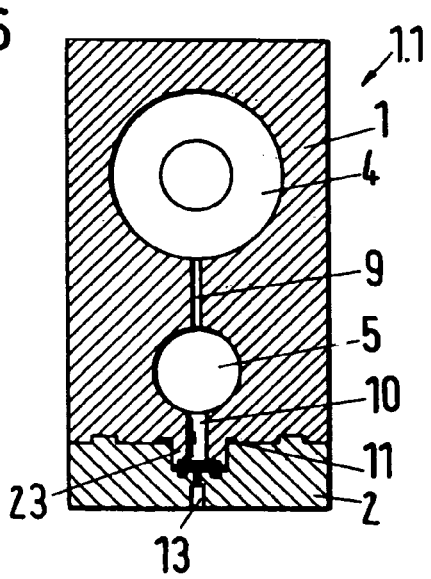
FIG. 6 is a cross section taken along line VI-VI of FIG. 1.
Figure 10:
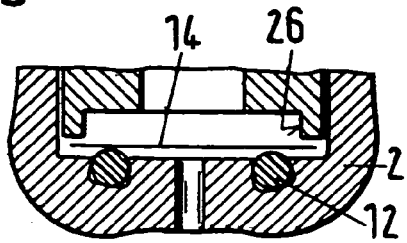
Figure 11:
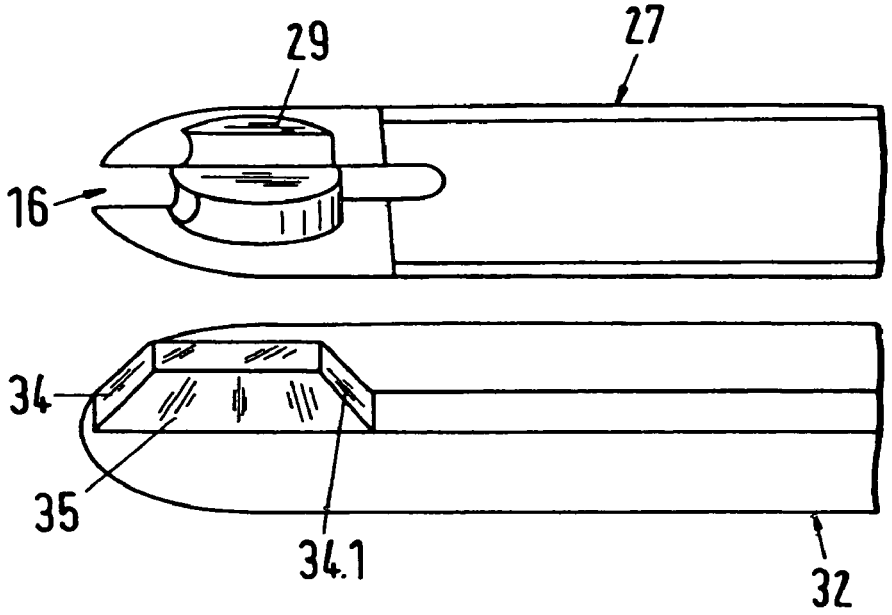
FIG. 11 is an exploded perspective view of the inner end of the installation apparatus.

As shown in FIG. 6 the chambers 4 and 5 are basically cylindrical and are interconnected through a partition 8 by a row of vertical passages 9. A slot passage 10 extends downward from the lower chamber 5 along a downwardly projecting extension ridge 23 that fits into an upwardly open seat groove 24 in the lower beam part 2 and is formed with vertical parallel flanks 26 (FIG. 10). The nozzle sheet 14 typically sits atop an oblong O-ring 12 fitted in an elongated and upwardly open annular groove 12" that runs around a vertically throughgoing slot 13 formed in the bottom wall of the part 2. It is held in place by the pressure above it. An end of the beam can be opened to form a repair port 12.2 at one end of the groove 12". This construction is generally standard and can be as described in somewhat more detail in the above-cited U.S. patents that are herewith incorporated by reference.

A release device 32 and an O-ring holding device 27, to be explained in greater detail below, are basically formed as somewhat flexible sheet-metal bars or strips that extend longitudinally parallel to each other and that normally rest flatly one against the other. The release device 32 and the O-ring holding device 27 together with an elongated pressure rail 38 (FIG. 2) form an installation tool for simplified installation of the seal 12. The pressure rail 38 may have approximately the same length as the holding device 27.

For replacement of the O-ring it is not necessary according to the invention to detach the lower part 2 from the upper part 1. In accordance with the invention as shown in FIG. 10 the repair slot 26 in part defined by the projection 23 and groove 24 extends the entire length of the nozzle strip 14 and of the seal-ring groove 12". The height of the repair slot 26 is slightly greater than the diameter, i.e. the thickness, of the O-ring 12. The distance between inner and outer holders 29 and 30 carried on the device 37 is such that when the O-ring 12 is fitted over them it is stretched so as to have a pair of straight and parallel side regions 12.5 and a pair of semicircular end region 12.3 bridging them.

For installing the O-ring 12, the O-ring holding device 27 to which the seal ring 12 has been fitted is pushed into the repair slot 26. The holders 29 and 30 projecting down from its underside 27.1 are formed with semicircular annular grooves 29.1 and 30.1 into which (FIG. 9) the O-ring 12 is fitted when stretched. The diameters of the seal-ring groove 12" provided in the lower part 2 approximately corresponds to the diameters of the annular grooves 29.1 and 30.1 in the two holders 29 and 30, so that, as explained in greater detail below, the O-ring 12 may be pressed down by the holders 29 and 30 and pushed into the seal-ring groove 12".

In addition, a width B2 of the O-ring holding device 27, is slightly greater than the overall width B1 of the ring 12 when it is stretched and fitted over the holders 29 and 30 so that it overlaps and protects this seal ring 12 during installation. The device 27 is formed as a handle 31 (FIG. 2) outboard of the outer holder 30, which is generally centrally mounted in the device 27, whereas the holder 29 is at the opposite end from the handle 31. As shown in particular in FIG. 2, the seal-ring groove 12" for installation of the O-ring 12 is provided with a recess 12.2 on each of the end faces of the nozzle beam 1.

Figure 13:
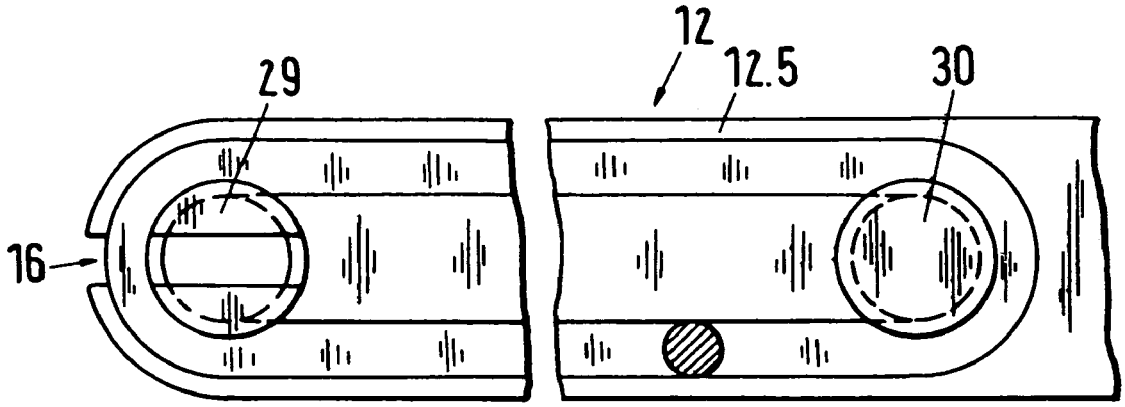
FIG. 13 is a bottom view of the inner region of the installation tool with the seal ring stretched over it.

According to FIG. 13, the distance between the inner and outer holders 29 and 30 for the O-ring 12 is greater than the length of the closed O-ring 12, so that the O-ring 12 is thus slightly stretched to allow insertion into the annular grooves 29.1 in the holders 29 and 30.

Figure 8:
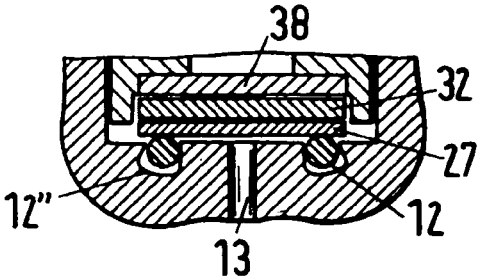

In addition to the O-ring holding device 27 and release device 32, the installation tool includes the pressure rail 38, which according to FIG. 8 is pushed into the opening 12.1, above the release device 32.

Figure 15:
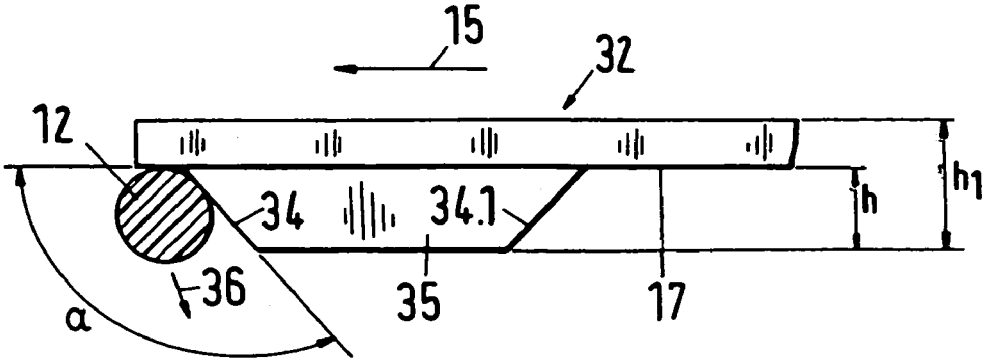
FIG. 15 is a large-scale side view of the inner end of the release device.

According to FIG. 15 the release device 32 has a release element 35 having two inclined wedge faces 34 and 34.1. The face 34 can be pushed against the annular part 12.3 of the O-ring 12 where it is engaged around the inner holder 29, to press the O-ring 12 downward according to FIG. 15 when the release device 32 resting on the O-ring holding device 27 is moved slightly to the left according to FIG. 15, inside the groove 24 in the holding device 27, which is then stationary. The face 34 for the release element 35 defined an angle $\alpha$ greater than 90° with respect to a surface 17 of the release element 35.

Figure 12:
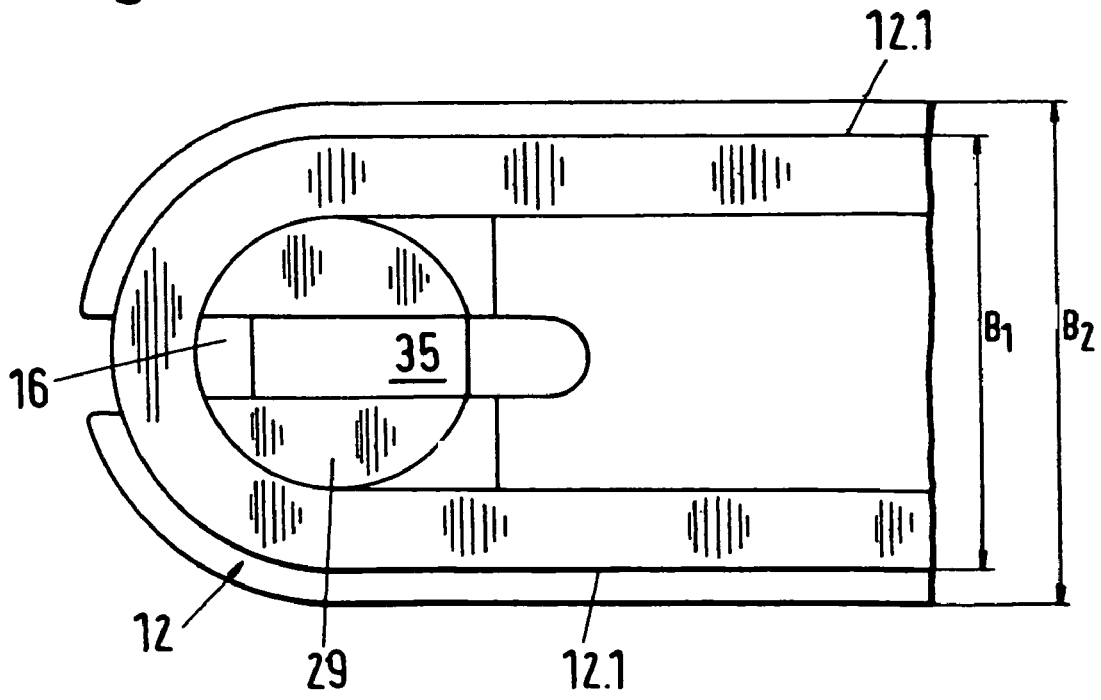
FIG. 12 is a large-scale bottom view of the inner end of the installation apparatus with the seal ring stretched over it.
Figure 14:
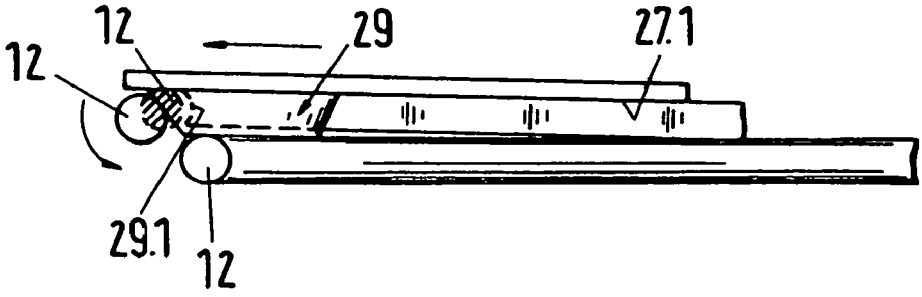
FIG. 14 is a schematic side view illustrating operation of the installation tool according to the invention.

According to FIG. 12, the left holder 29 is provided on one end with a longitudinally open slot 16 through which the release element 35 extends and in which the element 35 can move as shown by to arrow 15 to come to rest against the annular part 12.3 of the O-ring seal 12, and to push this annular part from the annular groove 29.1 as explained below. The actuating motion of the release device 32 causes the annular part 12.3 of the O-ring 12 to move along the sliding release element 35 according to FIG. 14, and to move downward according to arrow 36 until it is pushed or locked into the seal-ring groove 12".

The process sequence for inserting the O-ring 12 into the seal-ring groove 12" is schematically illustrated in FIGS. 2 through 5.

Figure 2:
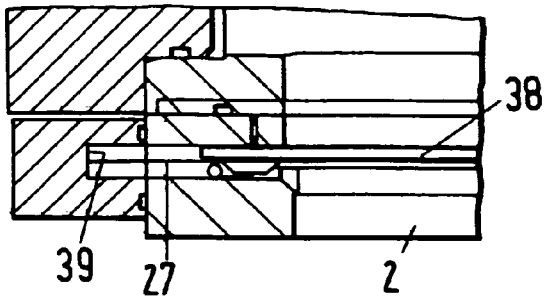
FIG. 2 is a large-scale view corresponding to a detail of FIG. 1 during installation of a fresh seal.
Figure 4:
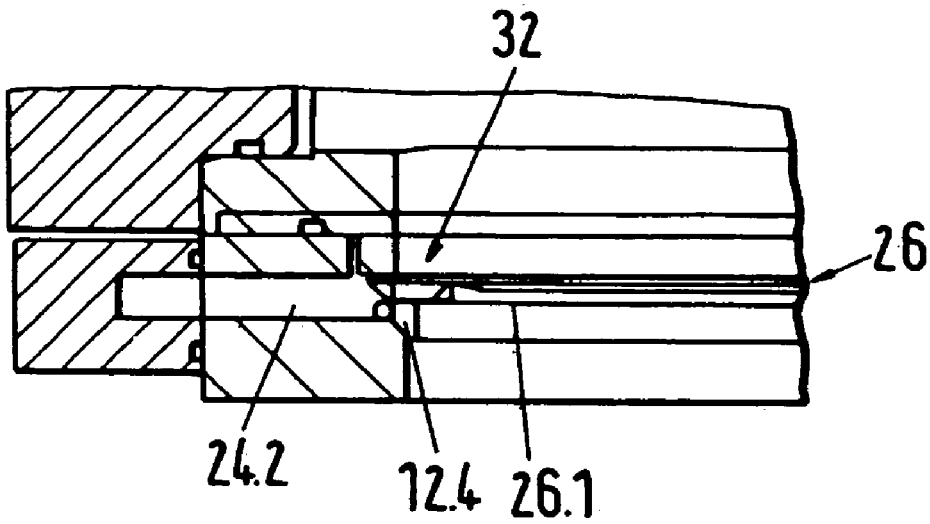
FIG. 4 is a view like FIG. 2 showing an earlier stage of the seal-ring installation.
Figure 7:
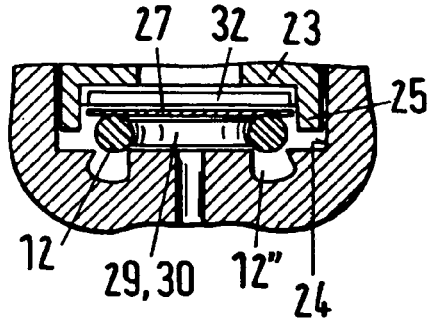
FIGS. 7, 8, 9, and 10 are detail cross sectional views of the nozzle beam at various stages of seal-ring installation and after the installation is complete.

After the O-ring 12 is mounted on the holders 29 and 30 according to FIG. 13, the O-ring holding device 27 and the release device 32 are together pushed into the repair slot 26, above the groove 24 according to arrow 37, until they have reached the position according to FIGS. 2 and 7. For this purpose the repair slot 26 has a height which is slightly greater than a height H1 of the entire release device 32, so that the release device 32 may be pushed over a base 26.1 of the repair slot 26 (FIG. 4).

Figure 9:
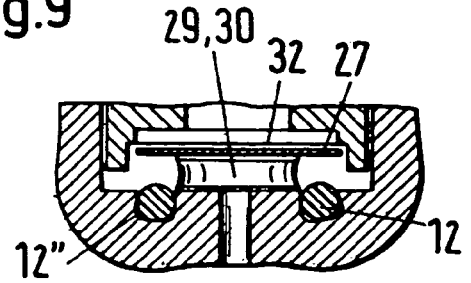

By means of the O-ring holding device 27, i.e. the positioning strip, and the release device 32 the O-ring 12 can be pushed through the groove 24 until the O-ring holding device 27 comes to rest against a stop surface 39 provided at the end of the groove 24. In this position the O-ring 12 according to FIG. 9 is positioned exactly above the seal-ring groove 12". Then the release device 32 is pushed inward relative to the holding device 27 to push the inner bight portion 12.3 off the inner holder 29. The pressure rail 38 is then pushed in above the release device 32 (FIG. 8) and thus pushes the O-ring 12 into the seal-ring groove 12". According to FIG. 7, the seal-ring groove 12" has a slight upward taper in order to securely hold the O-ring inserted into the seal-ring groove.

Figure 3:
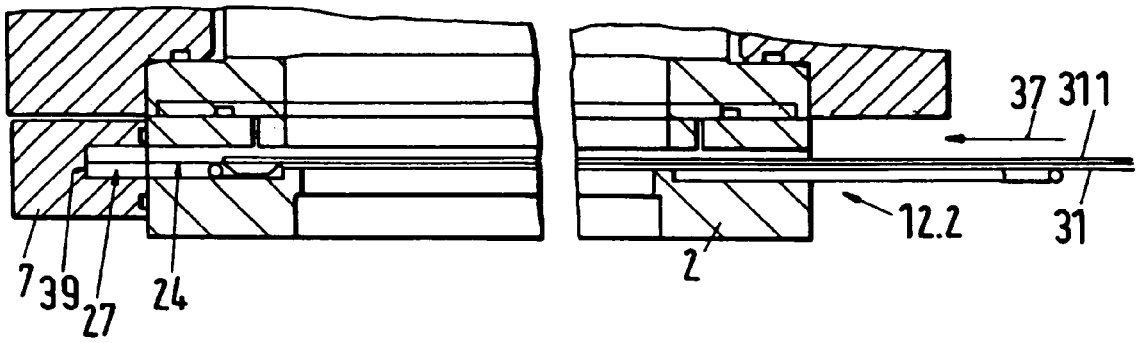
FIG. 3 is a large-scale view of the nozzle beam as in FIG. 1 at another stage of the seal-ring installation.

According to FIG. 3, on the right side of the O-ring holding device 27 the O-ring 12 may then be easily removed by hand from the holder 30 and pushed into the seal-ring groove 12", since the repair slot 28 in the region of the right seal-ring groove 12" may be easily accessed via the opening 12.2, whereas the left portion of the groove 24 is completely inaccessible. Heretofore, for installing the O-ring 12 without the release device 32 two persons were required, specifically, one person on the right side and the other person on the left side of the unit, to enable the O-ring 12 to be inserted into both seal-ring grooves 12" on the left and right sides.

The pressure rail 38 may then be pushed out from the opening 12.1 once again, thereby creating space for the installation tool from above and for the opening 12.1 (FIG. 9), thus allowing the holding device and the release device to be raised and removed and the nozzle strip 14 to be pushed into the groove 24 (FIG. 10).

We claim:

1. In combination with a nozzle beam formed with an annular groove, an apparatus for mounting an elastomeric seal ring in the groove, the apparatus comprising:

an elongated support bar;

inner and outer holders fixed on the bar spaced apart sufficiently that the seal ring can be stretched between them; and means on the bar including a release element for pushing the seal ring off the inner holder.

2. The combination defined in claim 1 wherein the means further includes a release bar longitudinally slidable on the support bar and carrying the release element.

3. The combination defined in claim 2 wherein the release element has a pusher face engageable with the seal on the inner holder.

4. The combination defined in claim 3 wherein the pusher face forms an obtuse angle with a longitudinal axis of the support bar.

5. The combination defined in claim 4 wherein the angle is between 120° and 150°.

6. The combination defined in claim 2 wherein the holders each have an arcuate face that is convex away from the outer holder.

7. The combination defined in claim 6 wherein the arcuate faces are formed with shallow grooves adapted to hold the seal ring.

8. The combination defined in claim 6 wherein the inner holder is formed with a slot open away from the outer holder and the release element is shiftable between an inactive position recessed behind the face of the inner holder and an active position projecting past the face of the inner holder.

9. The combination defined in claim 1 wherein the inner holder and release element are at an end of the support bar and the outer holder is generally central in the support bar.

10. The combination defined in claim 1 wherein the nozzle beam has a surface formed with the groove and is formed with an end port aligned with the surface and of a height equal generally to an overall transverse height of the support bar and holders such that the support bar with holders and release element can be fitted into the end port.

11. The combination defined in claim 10, further comprising a pressure bar insertable into the port above the support bar to press the support bar and release element down in the beam.

* * * * *